US007694661B2

(12) United States Patent
Ueshima et al.

(10) Patent No.: US 7,694,661 B2
(45) Date of Patent: Apr. 13, 2010

(54) CRANKCASE, METHOD OF CASTING A CRANKCASE, AND A MULTIPLE-CYLINDER FOUR-CYCLE ENGINE COMPRISING THE CRANKCASE

(75) Inventors: Atsushi Ueshima, Akashi (JP); Ryo Iwata, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 448 days.

(21) Appl. No.: 11/901,248

(22) Filed: Sep. 14, 2007

(65) Prior Publication Data

US 2008/0066573 A1 Mar. 20, 2008

(30) Foreign Application Priority Data

Sep. 15, 2006 (JP) ..... 2006-251035

(51) Int. Cl.
*F02B 77/00* (2006.01)
*B22D 23/00* (2006.01)

(52) U.S. Cl. ..... 123/195 R; 164/47; 29/888.01

(58) Field of Classification Search ..... 123/195 R; 29/888.01, 888.06; 164/47, 137
See application file for complete search history.

(56) References Cited

FOREIGN PATENT DOCUMENTS

| | | |
|---|---|---|
| JP | 11-182325 | 7/1999 |
| JP | 2005-069170 | 3/2005 |

*Primary Examiner*—Noah Kamen
(74) *Attorney, Agent, or Firm*—Alleman Hall McCoy Russell & Tuttle LLP

(57) ABSTRACT

A crankcase for a multiple-cylinder four-cycle engine, including an upper crankcase and a lower crankcase which are joined to each other at a joint surface; a separating wall which is integrally cast with the upper crankcase and the lower crankcase to extend from the joint surface toward the opposite side of the joint surface and are configured to define crank chambers corresponding to adjacent cylinders; and a crank journal bearing hole which is formed on the separating wall and is configured to support a crankshaft. At least the separating wall formed in the upper crankcase has a thickness that increases from the joint surface of the crankcase to a region near a deepest portion of the crank journal bearing hole and decreases from the region near the deepest portion of the crank journal bearing hole toward the opposite side of the joint surface of the crankcase.

6 Claims, 8 Drawing Sheets

C: CRANKSHAFT SIDE (JOINT SURFACE SIDE)

H: CYLINDER SIDE (JOINT SURFACE OPPOSITE SIDE)

C:CRANKSHAFT SIDE (JOINT SURFACE SIDE)

H:CYLINDER SIDE (JOINT SURFACE OPPOSITE SIDE)

CRANKCASE, METHOD OF CASTING A CRANKCASE, AND A MULTIPLE-CYLINDER FOUR-CYCLE ENGINE COMPRISING THE CRANKCASE

TECHNICAL FIELD

The present invention generally relates to a multiple-cylinder four-cycle engine mounted in a vehicle such as a motorcycle. More particularly, the present invention relates to a crankcase and a method of casting the crankcase.

BACKGROUND OF THE INVENTION

Typically, a crankcase and a cylinder block forming a multiple-cylinder four-cycle engine equipped in a vehicle such as a motorcycle are manufactured by casting. In case of the motorcycle, the engine is mounted to a frame member disposed between a front wheel and a rear wheel. The engine and a transmission are mounted in a limited space below a fuel tank mounted to an upper region of the frame member to drive the rear wheel. So, a cylinder of the engine is positioned on the front wheel side and the transmission is positioned on the rear wheel side. The engine is typically manufactured in such a way that the cylinder block, a transmission case and a crankcase are integrally cast by die casting.

In the multiple-cylinder four-cycle engine, since crank chambers of respective cylinders are separated by separating walls, air in each crank chamber is compressed by a piston moving downward, causing a pumping loss. In addition, a mixture of air and oil, namely, an oil mist, existing in the respective crank chambers, is scattered by a crank web or the like rotating at a high speed in the crank chambers to cause a large friction resistance. In some engines, crank chambers of adjacent cylinders are connected to each other through a connecting hole in order to reduce the pumping loss or the friction resistance.

Prior art that was configured to address these concerns is disclosed by Japanese Laid-Open Patent Application Publication No. Hei. 11-182325. According to this application, connecting holes connecting crank chambers of cylinders are formed to extend over piston sliding surfaces inside cylinders and crankcase parts, and a center of each connecting hole is located on the sliding surface side of the piston.

A similar prior art concept is disclosed in Japanese Laid-Open Patent Application Publication No. 2005-69170 which was previously filed by the applicant. In this application, connecting holes are formed to penetrate separating walls defining cylinder bores and crank chambers of adjacent cylinders.

A multiple-cylinder four-cycle engine for motorcycles in some cases has a cylinder block having a closed deck structure in which an upper region of a water jacket formed in a cylinder block is closed, in order to increase a degree of roundness of an inner diameter of the cylinder at an upper region of the cylinder block. However, since it may be difficult to manufacture via die casting, a cylinder block having a closed deck structure is generally manufactured via sand casting using a sand mold.

FIG. 6 is a perspective view showing a prior art example of an upper crankcase 52 of a crankcase 51 of an engine for a motorcycle. As shown in FIG. 6, the upper crankcase 52 is inverted in casting. The upper crankcase 52 has a cylinder block 53 having the above mentioned closed deck structure and an upper transmission case 54 which are integrally cast and formed by using a sand mold.

FIG. 7 is a longitudinal sectional view schematically showing the upper crankcase 52 of FIG. 6 and a casting mold 60 for casting the upper crankcase 52. As shown in FIG. 7, a casting mold 60, which is a sand mold, includes a lower die 61, a front die 62, a side die (located in a direction perpendicular to a sheet of FIG. 7 and thus is not shown) provided at a side surface, a rear die 63, a pouring gate die 64 forming a pouring gate 65 from which liquid metal is fed into the casting mold 60, an upper die 70, and a cylinder bore die 66. The casting mold 60 further includes a crankshaft side core 69 and a cylinder side core 68, to form intricate inner wall surfaces of crank chambers 56 (FIG. 6) of the upper crankcase 52.

FIG. 8 is a cross-sectional view taken along line VIII-VIII of FIG. 7, schematically showing the casting cores 68 and 69 for forming the crank chamber 56 (FIG. 6) of the crankcase. As shown in FIG. 8, the crankshaft side core 69 is provided in contact with the upper die 70 at a joint surface 55, and a cylinder side core 68 is provided on the cylinder side with respect to the crankshaft side core 69 in contact with the crankshaft side core 69 at a parting plane 75. The cores 68 and 69 respectively have drafts 80 and 81 having a width that decreases from a joint surface 55 of the crankshaft side C toward the cylinder side H.

As shown in FIGS. 6 and 7, a connecting hole 58 is formed on each separating wall 57 for defining the crank chamber 56 of the upper crankcase 52 to reduce friction resistance and the like within each crank chamber 56. In addition, a cut portion 78 is formed on each separating wall 57 to reduce the weight of the upper crankcase 52. The cut portion 78 may be formed on each separating wall 57 between adjacent cylinders by a shape of the sand mold of the cylinder side core 68.

In casting, flash may be left at an end portion E of the parting plane 75. The flash must be removed to smooth-finish the inner wall surface, or the like, of the crank chamber 56. However, in the prior art discussed above the parting plane 75 is positioned in close proximity to a joint portion at which the upper crankcase 52 is joined to the cylinder block 53, (i.e. in a narrow space) and cut portion 78 is located closer to the cylinder side H than parting plane 75. For these reasons, an operator may have to take painstaking efforts to carefully remove the flash by hand. In order to smooth-finish corner regions of the cut portions 78 and surfaces of the separating walls 57, the operator must remove the flash not only in the vicinity of the parting plane 75 but in the vicinity of the cut portions 78 existing in the narrow spaces.

In addition, it will be appreciated that it may be desirable to increase the output of high-power engines such as the above described engine for motorcycles, and that it may also be desirable to increase the output of multiple-cylinder four-cycle engines for motorcycles.

SUMMARY OF THE INVENTION

The present invention addresses the above described conditions, and an object of the present invention is to provide a crankcase which enables a higher output power of an engine, and a casting method thereof, which enables easy finishing after casting, as well as a multi-cylinder four-cycle engine comprising the crankcase.

According to one aspect of the present invention, there is provided a crankcase for a multiple-cylinder four-cycle engine, comprising an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof; a separating wall which is integrally cast with the upper crankcase and the lower crankcase to extend from the joint surface toward the opposite side of the joint surface and is configured to define crank chambers corresponding to adjacent cylinders; and a crank journal bearing hole which is formed on the separating wall such that an axis of the bearing hole passes through the joint surface of the upper crankcase and the lower crankcase and is configured to support a crankshaft; wherein at least the separating wall formed in the upper crankcase has a thickness that increases from the joint surface of the crankcase to a region near a deepest portion of the crank journal bearing hole and decreases from the region near the deepest portion of the crank journal bearing hole toward the opposite side of the joint surface of the crankcase.

In such a construction, since each of the separating walls defining the crank chambers corresponding to adjacent cylinders within the crankcase has a thickness that decreases from the region near the deepest portion of the crank journal bearing hole toward the opposite side of the joint surface of the crankcase, an internal volume of the crankcase can be increased and thus a pressure fluctuation occurring in the interior of the crank chamber can be reduced. As a result, the output power of the engine can be increased. In addition, since a sufficient distance is provided between a crank web of a crankshaft accommodated in the crank chamber and the separating wall, friction resistance of the crank web can be reduced, and a power loss can be decreased.

The upper crankcase may have a cylinder block which is formed integrally therewith and is located on an opposite side of the joint surface.

The crankcase may further comprise a cut portion which is formed in a portion of the separating wall whose thickness decreases from the region near the deepest portion of the crank journal bearing hole toward the opposite side of the joint surface and is configured to allow the crank chambers corresponding to adjacent cylinders to fluidically communicate with each other, and a corner portion of the cut portion formed on a surface of the separating wall may be formed by a curved surface. The cut portion enables smooth air flow between the crank chambers. Thereby, a pressure fluctuation in the interior of each crank chamber can be reduced. Also, by forming the corner portion of the cut portion by a large curved surface, an operation to remove the flash at the corner portion may be omitted, and the stress generated at the corner portion can be decreased.

According to another aspect of the present invention, there is provided a multiple-cylinder four-cycle engine comprising a crankcase, the crankcase including: an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof; a separating wall which is integrally cast with the upper crankcase and the lower crankcase to extend from the joint surface toward the opposite side of the joint surface and is configured to define crank chambers corresponding to adjacent cylinders; and a crank journal bearing hole which is formed on the separating wall such that an axis of the bearing hole passes through the joint surface of the upper crankcase and the lower crankcase and is configured to support a crankshaft; wherein at least the separating wall formed in the upper crankcase has a thickness that increases from the joint surface of the crankcase to a region near a deepest portion of the crank journal bearing hole and decreases from the region near the deepest portion of the crank journal bearing hole toward the opposite side of the joint surface of the crankcase.

Thereby, the multiple-cylinder four-cycle engine is able to reduce pressure fluctuation occurring inside the crank chamber and reduce friction resistance associated with rotation of the crank web, thereby increasing the output power with a small power loss.

According to another aspect of the present invention, there is further provided a method of casting a crankcase for a multiple-cylinder four-cycle engine, including an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof, a separating wall which is integrally cast with the upper crankcase and the lower crankcase to extend from the joint surface toward the opposite side of the joint surface and is configured to define crank chambers corresponding to adjacent cylinders; and a crank journal bearing hole which is formed on the separating wall such that an axis of the bearing hole passes through the joint surface of the upper crankcase and the lower crankcase and is configured to support a crankshaft; the method comprising: providing a joint surface side core and a joint surface opposite side core, the joint surface side core having a draft for increasing a thickness of the separating wall from the joint surface of the crankcase to a region near a deepest portion of the crank journal bearing hole, the joint surface opposite side core being provided in contact with the joint surface side core to form a contact surface and having a draft for decreasing a thickness of the separating wall from the region near the deepest portion of the crank journal bearing hole toward the opposite side of the joint surface of the crankcase; feeding liquid metal into a casting mold in a state where a parting plane between the joint surface side core and the joint surface opposite side core is located in close proximity to the deepest portion of the crank journal bearing hole; and forming the separating wall to have the thickness that increases from the joint surface of the crankcase to the region near the deepest portion of the crank journal bearing hole and decreases from the region near the deepest portion of the crank journal bearing hole toward the opposite side of the joint surface of the crankcase.

In the above method, since the crankcase is cast in such a manner that the each of the separating walls defining the crank chambers corresponding to the cylinders within the crankcase has a thickness that decreases from the region near the deepest portion of the crank journal bearing hole toward the opposite side of the joint surface of the crankcase, the internal volume of the crankcase is increased so as to reduce the pressure fluctuation occurring in the interior of the crank chamber, and the output power of the engine can be increased. In addition, since a sufficient distance can be provided between a crank web of a crankshaft accommodated in the crank chamber and the separating wall, friction resistance associated with rotation of the crank web can be reduced, and a power loss can be decreased. Furthermore, in this casting method, the flash left at the parting plane between the joint surface side core and the joint surface opposite side core can be positioned near the deepest portion of the crank journal bearing hole. As a result, the flash at the parting plane can be removed easily after the casting.

The method may further comprise forming a cut portion which is formed by the joint surface opposite side core in a portion of the separating wall with a thickness that decreases from the region near the deepest portion of the crank journal bearing hole toward the opposite side of the joint surface of the crankcase and is configured to allow the crank chambers corresponding to adjacent cylinders to fluidically communicate with each other. A corner portion of the cut portion formed on a surface of the separating wall may be formed by a curved surface. In this construction, the large cut portion is formed on the separating wall to extend from the region near the deepest portion of the crank journal bearing hole to the opposite side of the joint surface so that the air smoothly communicates between the cylinders of the crank chambers, and thus pressure fluctuation caused by up-down movement of a piston in a cylinder of the engine can be reduced. Since the corner portion of the cut portion is formed by the large curved surface by the joint surface opposite side core, an operation to remove the flash at the corner portion may be omitted, and the stress generated at the corner portion can be decreased.

The above and further objects and features of the invention will more fully be apparent from the following detailed description with accompanying drawings.

DETAILED DESCRIPTION OF THE PREFERRED EMBODIMENTS

Figure 5:
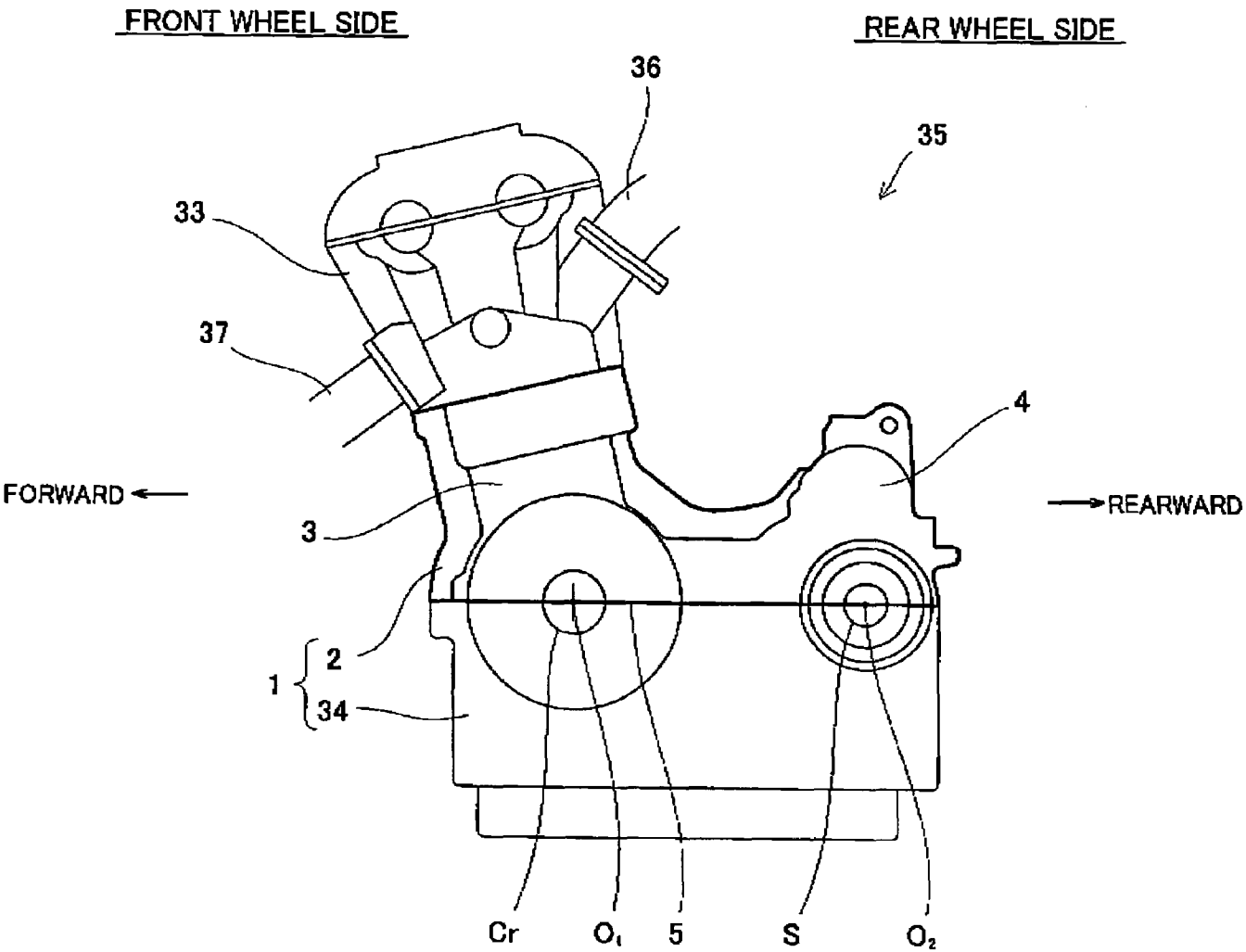
FIG. 5 is a left side view showing an example of an engine for a motorcycle including the upper crankcase of FIG. 1.
Figure 6:
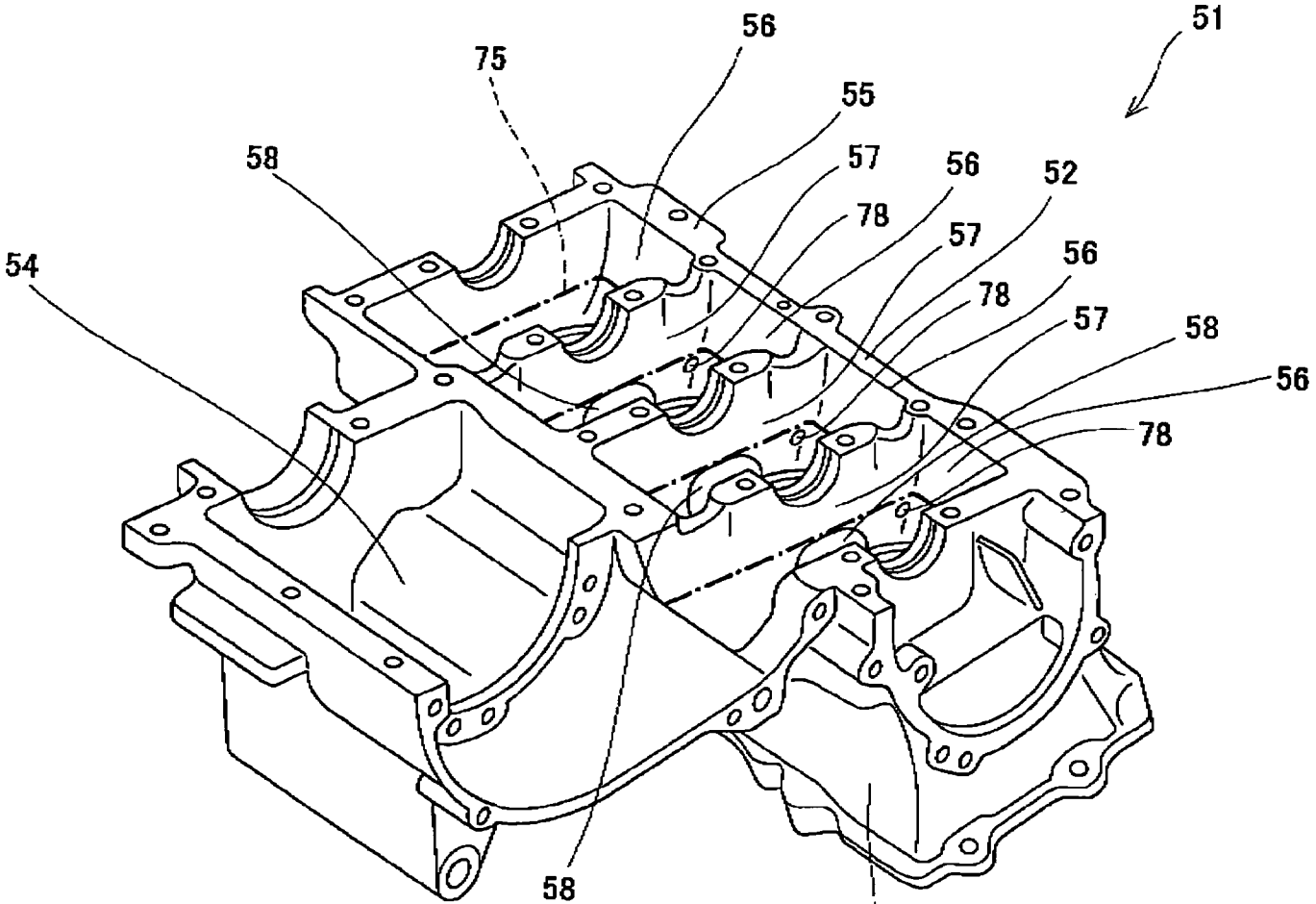
PRIOR ART Fig. 6
FIG. 6 is a perspective view showing an example of a prior art upper crankcase.
Figure 7:
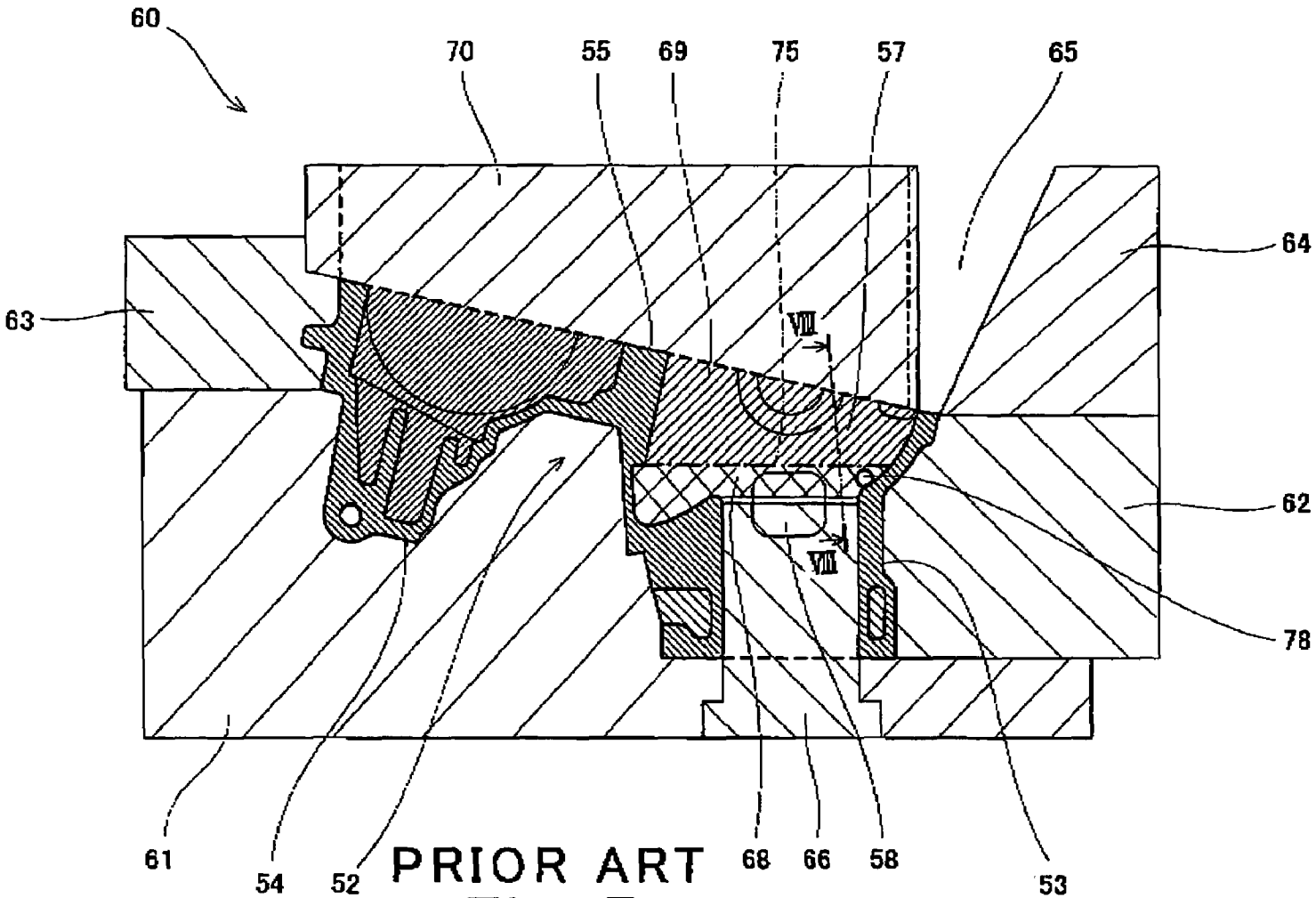
PRIOR ART Fig. 7
FIG. 7 is a longitudinal sectional view schematically showing the upper crankcase of FIG. 6 and a casting mold for casting the upper crank case.
Figure 8:
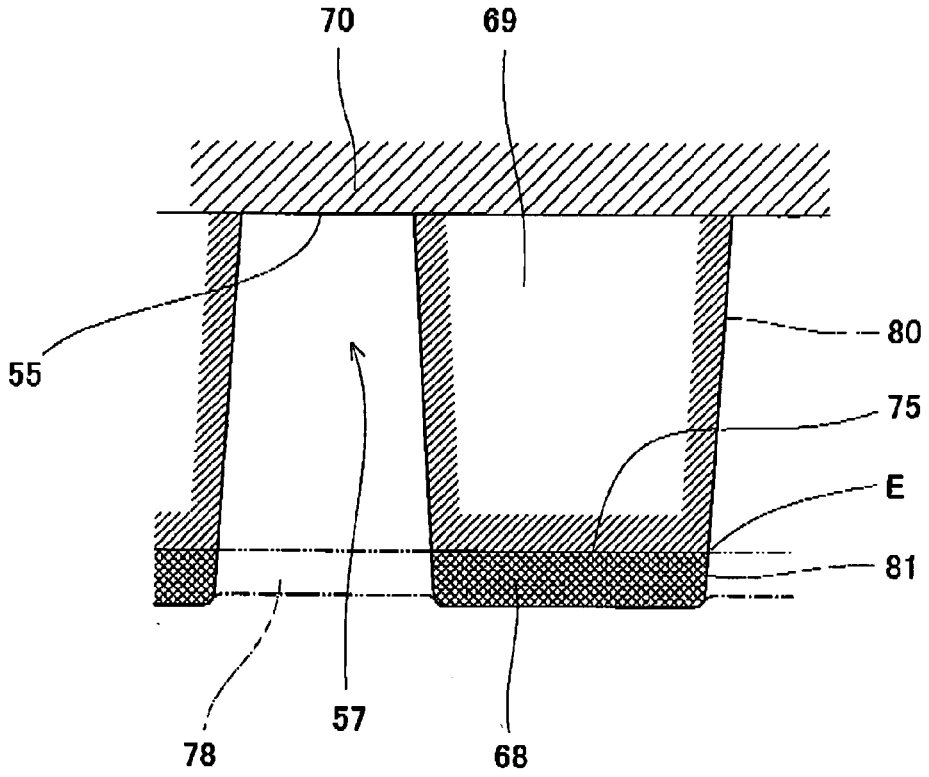
PRIOR ART Fig. 8
FIG. 8 is a cross-sectional view taken along line VIII-VIII of FIG. 7, schematically showing casting cores for forming the crank chamber of the upper crankcase.

Hereinafter, an embodiment of the present invention will be described with reference to the drawings. FIG. 5 is a side view of an engine 35 for a motorcycle including a crankcase 1 of the present invention, showing a state where the engine 35 is mounted in the motorcycle. As shown in FIG. 5, the engine 35 is a four-cycle four-cylinder engine, and includes the crankcase 1 composed of an upper crankcase 2 and a lower crankcase 34. The crankcase 1 is separated into the upper crankcase 2 and the lower crankcase 34 which are disposed on upper and lower sides at a plane (joint surface) 5 passing through a center axis O1 of a crankshaft Cr and a center axis O2 of an output shaft S. The crankshaft Cr is rotatably retained between the upper crankcase 2 and the lower crankcase 34 from above and from below and extends horizontally in a lateral direction of the motorcycle. The upper crankcase 2 has a cylinder block 3 and an upper transmission case 4 which are integrally cast. The cylinder block 3 is provided with a cylindrical cylinder bore inside thereof to accommodate a piston and is inclined toward a front wheel, i.e., forward, with respect to the crankshaft Cr at an upper side of the upper crankcase 2. The upper transmission case 4 extends toward a rear wheel, i.e., rearward with respect to the crankshaft Cr to a position at a rear portion of the upper crankcase 2. A cylinder head 33 is provided on an upper region of the cylinder block 3. An air-intake pipe 36 and an exhaust pipe 37 are coupled to the cylinder head 33.

Figure 1:
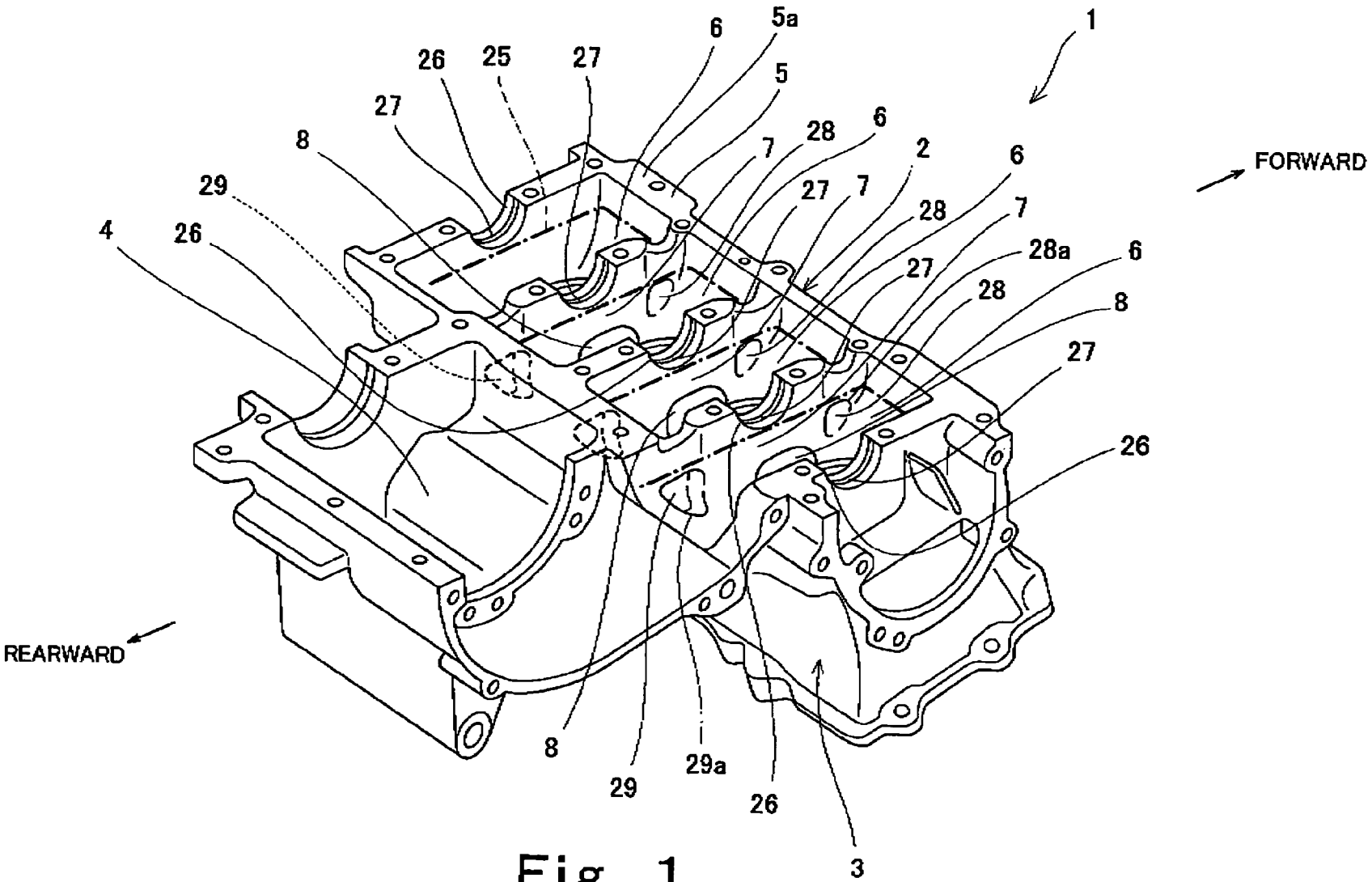
FIG. 1 is a perspective view of an upper crankcase according to an embodiment of the present invention.
Figure 2:
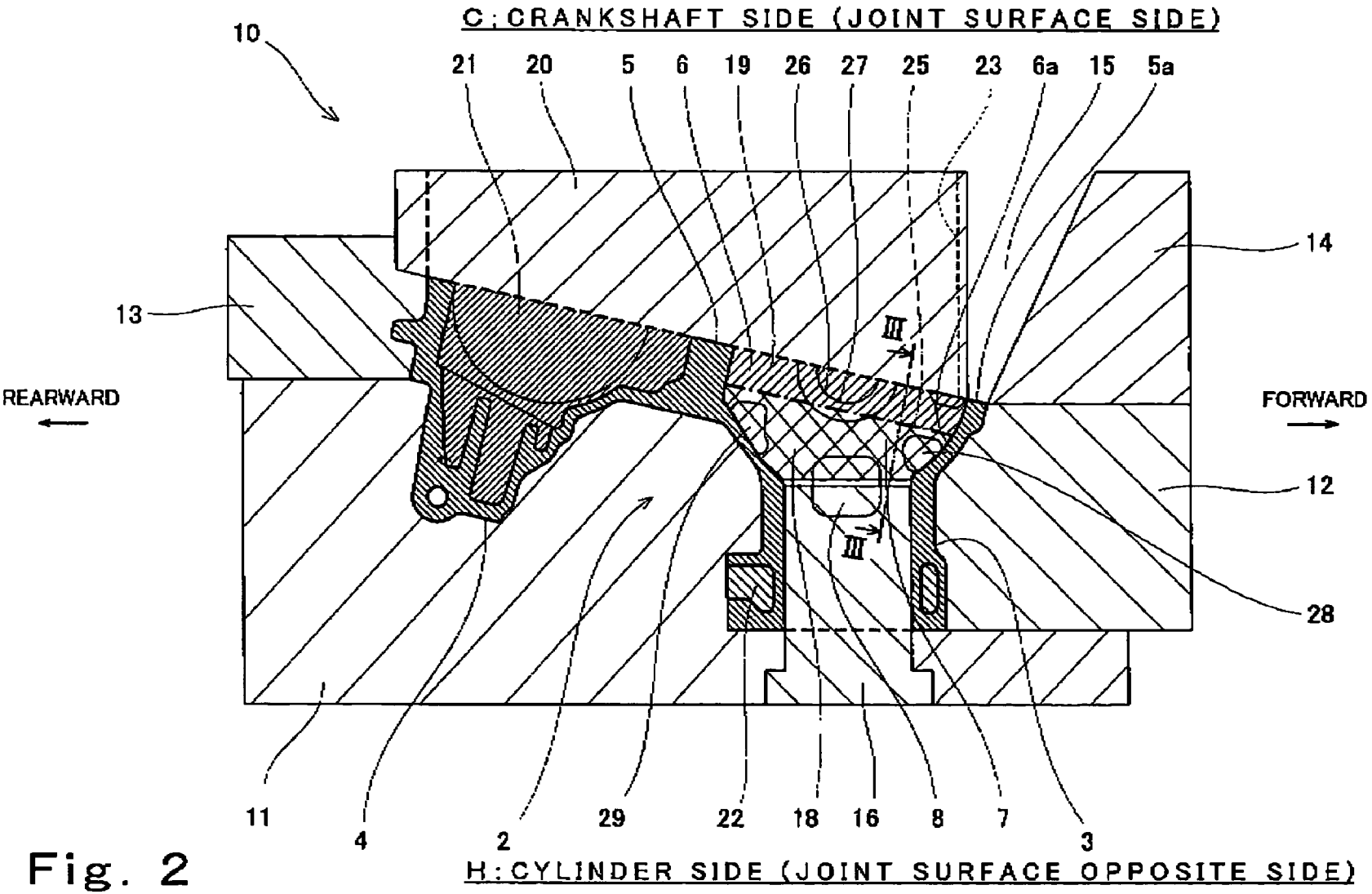
FIG. 2 is a longitudinal sectional view schematically showing the upper crankcase of FIG. 1 and a casting mold for casting the upper crankcase.
Figure 3:
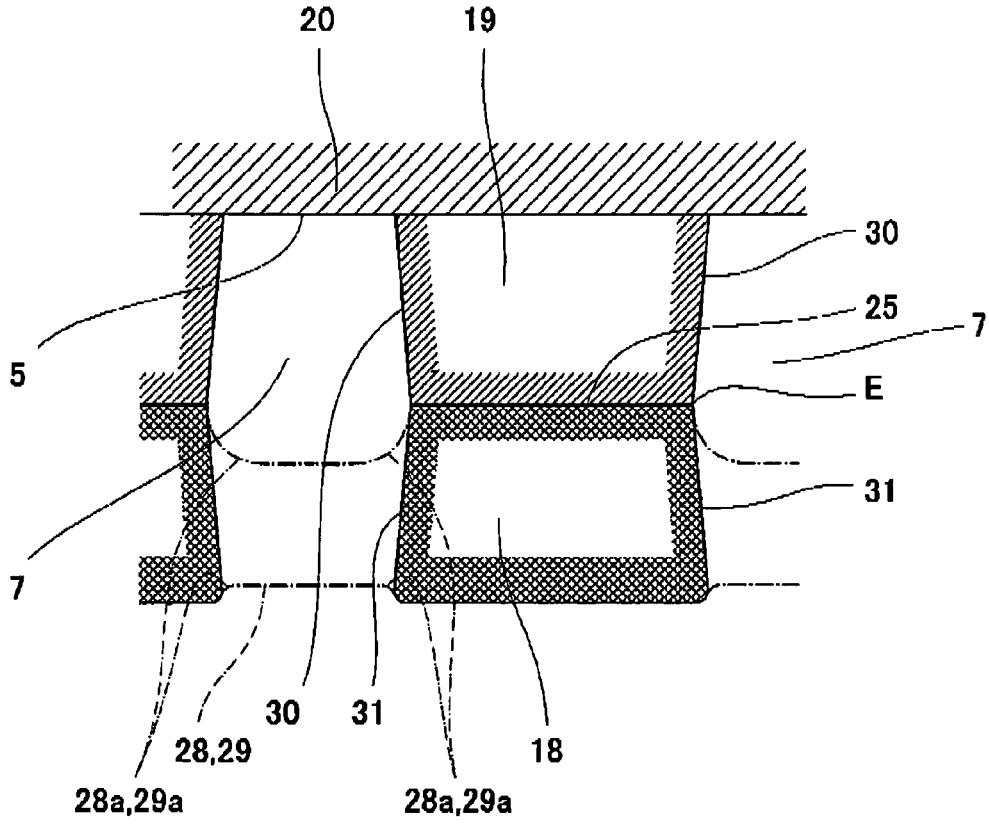
FIG. 3 is a cross-sectional view taken along line III-III of FIG. 2, schematically showing casting cores for forming crank chambers of the upper crankcase.

FIG. 1 is a perspective view of the upper crankcase 2 of FIG. 5. FIG. 2 is a longitudinal sectional view schematically showing the upper crankcase 2 of FIG. 1 and a casting mold for casting the upper crankcase 2. FIG. 3 is a cross-sectional view taken along line III-III of FIG. 2, schematically showing casting cores for forming crank chambers 6 (FIG. 1) of the upper crankcase 2. As shown in FIG. 1, the upper crankcase 2 has the cylinder block 3 and the upper transmission case 4 which are integrally cast. In this embodiment, the upper crankcase 2 is cast in a state where the upper crankcase 2 mounted in the motorcycle as shown in FIG. 5 is inverted. In other words, the upper crankcase 2 is cast in a state where the joint surface 5 side is an upper side and the cylinder block 3 side (which is an opposite side of the joint surface 5 side) is a lower side. FIGS. 1 to 3 show the inverted state of the upper crankcase 2.

Turning to FIG. 1, an upper surface of the upper crankcase 2 facing upward in the drawing is the joint surface 5. The lower crankcase 34 (FIG. 5) is coupled to the joint surface 5. The upper crankcase 2 includes the four crank chambers 6 which are separated by separating walls 7 and arranged in the lateral direction. The four crank chambers 6 respectively correspond to four cylinders of the engine, and are configured to accommodate the crankshaft Cr (FIG. 5). A connecting hole 8 is formed on each of the separating walls 7 to permit fluid air communication between the adjacent crank chambers 6. Hereinbelow, the joint surface 5 side of the upper crankcase 2, which is an upper side in FIGS. 1 to 3 and a lower side in FIG. 5, may be in some cases referred to as crankshaft side C, and the opposite side of the joint surface 5 which is a lower side in FIGS. 1 to 3 (upper side in FIG. 5) may be in some cases referred to as cylinder side H. The lateral direction and longitudinal direction are referenced in the state where the upper crankcase 2 is mounted in the motorcycle.

As shown in FIG. 2, an inner wall surface 6*a* of each of the crank chambers 6 of the upper crankcase 2 is formed by upper and lower cores defined by a parting plane 25, described later. The parting plane 25 is positioned in the vicinity of a peripheral region of a deepest portion 27 (portion which is most distant from the joint surface 5) of a crank journal bearing hole 26 formed on the separating wall 7. Cut portions 28 and 29 are formed to penetrate the separating walls 7 in a location closer to the cylinder block 3 side (cylinder side H) than to the parting plane 25 to provide fluid air communication between the crank chambers 6.

As shown in FIG. 2, a casting mold 10 for casting the upper crankcase 2, formed of the cylinder block 3 and the upper transmission case 4 which are integrally cast, includes a lower die 11 for forming the cylinder block 3 and the upper transmission case 4 on the cylinder side H, a front die 12 for forming a front side (right side) of the upper crankcase 2, a side die (located in the direction perpendicular to the sheet of FIG. 4 and thus is not shown) for forming a side surface of the upper crankcase 2, a rear die 13 for forming a rear side (left side) of the upper transmission case 4, a pouring gate die 14 located above the front die 12 on the crankshaft side C, and an upper die 20 for forming the cylinder block 3 and the upper transmission case 4 on the crankshaft side C.

The pouring gate die 14 and the upper die 20 are arranged forward and rearward, respectively. A pouring gate 15 is defined by a rear end surface of the pouring gate die 14 and a front end surface of the upper die 20. Liquid metal is fed into the pouring gate 15 from above, i.e., from the crankshaft side C. The pouring gate 15 extends in the lateral direction, i.e., in the direction perpendicular to the sheet of FIG. 2 so that the liquid metal can be injected over an entire width in the lateral direction of a front end portion 5*a* (see FIG. 1*a*) of the joint surface 5 of the upper crankcase 2. The pouring gate 15 has a specified volume to reserve the liquid metal as a liquid metal reservoir. In this embodiment, as shown in the side cross-section in FIG. 2, a front end surface of the upper die 20 extends vertically, whereas a rear end surface of the pouring gate die 14 is inclined forward in such a manner that an upper end of the rear end surface is away from the front end surface of the upper die 20. Thus, the pouring gate 15 has a dimension in the longitudinal direction of the casting mold 10, which increases upward to have a sufficient volume and to enable the liquid metal to be fed easily from above. A plurality of risers 23, which form openings arranged in the lateral direction, are formed on the upper die 20 to penetrate vertically and extend forward and rearward. The risers 23 are located above the separating walls 7 between the cylinders in the upper crank case 2.

The lower die 11 is provided with a cylinder bore die 16 to form the cylinder bore in the cylinder block 3. A water jacket shell core 22 is provided between the cylinder bore die 16 and the lower die 11 and between the cylinder bore die 16 and the front die 12 to form a water jacket in the cylinder block 3. The lower die 11, the front die 12, the cylinder bore die 16, and the water jacket shell core 22 form a cylinder block forming part of the casting mold 10.

A cylinder side core (core on the opposite side of the joint surface 5) 1B forming a part of the inner wall surface 6*a* of the crank chamber 6 of the upper crankcase 2 is provided at an upper portion of the cylinder bore die 16. A crankshaft side core (joint surface side core) 19 is provided at an upper position of the cylinder side core 18 so as to form the inner wall surface 6*a* of the crank chamber 6 with the cylinder side core 18. The crankshaft side core 19 and the cylinder side core 18 form a crank chamber forming the core of the casting mold 10. The crank chamber forming core, the lower die 11, the front die 12, and the side die form a crank chamber, which in turn forms a part of the casting mold 10.

During casting, the crankshaft side core 19 is located under and connected to a lower end surface of a front portion of the upper die 20, and a transmission case portion core 21 forming an inner wall surface of the upper transmission case 4 is located under and connected to a lower end surface of a rear portion of the upper die 20. The upper die 20 is positioned in a vertical direction and in the lateral direction by the rear die 13 and the side die. The transmission case portion core 21, the crankshaft side core 19, and the cylinder side core 18 are formed of shell molds. In FIG. 2, intricate shapes of protruding portions of the cylinder side core 18, the crankshaft side core 19, and the transmission case portion core 21 are schematically shown.

As shown in FIG. 1, the parting plane 25 between the cylinder side core 18 and the crankshaft side core 19 is positioned in the vicinity of the deepest portion 27 of the crank journal bearing hole 26. As indicated by one-dotted lines in FIG. 2, in this example, the parting plane 25 extends in parallel with the joint surface 5 inclined upward in the direction from the upper crankcase 2 toward the upper transmission case 4.

As shown in FIGS. 1 and 2, the cut portions 28 and 29 are formed by the cylinder side core 18 so as to penetrate front and rear regions of the upper portion (cylinder side H) of the separating wall 7 defining the crank chamber 6. In this embodiment, the parting plane 25 is positioned in close proximity with the deepest portion 27 of the crank journal bearing hole 26 to increase a vertical dimension of the cylinder side core 18. Thus, by setting the dimension of the cylinder side core 18 larger in the depth direction of the crank chamber 6, the size of the cut portions 28 and 29 formed on the separating wall 7 can be made larger. As shown in FIG. 3, corner portions 28*a* and 29*a* (see FIGS. 1 and 3) of opening ends of the cut portions 28 and 29 which are formed on the surface of the separating wall 7, can be formed by curved surfaces with a large curvature. This makes it possible to reduce stress generated at end regions of the cut portions 28 and 29.

As shown in FIG. 3, since the draft (draft angle) 30 of the crankshaft side core 19 has a width that decreases from the joint surface 5 of the crankshaft side C toward a region near the deepest portion 27 (FIG. 2) of the crank journal bearing hole 26 (FIG. 2), while the draft 31 of the cylinder side core 18 has a width that increases from the region near the deepest portion 27 of the crank journal bearing hole 26 which is the parting plane 25 between the cylinder side core 18 and the crankshaft side core 19, toward the cylinder side H. The separating wall 7 formed by joining the cylinder side core 18 to the crankshaft side core 19 has a thickness which is largest at the parting plane 25 and decreases from the parting plane 25 toward the crankshaft side C and the cylinder side H. In FIG. 3, the drafts 30 and 31 are illustrated as having large inclination, but may be formed to have smaller inclination, for example, 2 degrees.

In accordance with the crankcase 1 constructed above, the separating wall 7 of the upper crankcase 2 of FIG. 1 has a thickness which increases from the joint surface 5 to the region near the deepest portion 27 of the crank journal bearing hole 26 and decreases from the region near the deepest portion 27 of the crank journal bearing hole 26 toward the cylinder side H (opposite side of the joint surface 5) as indicated by white area in FIG. 3. In other words, the separating wall 7 has a thickness which is largest in the region near the deepest portion 27 of the crank journal bearing hole 26 and is smaller on the joint surface 5 side and on the opposite side of the joint surface 5.

By positioning the parting plane 25 between the cylinder side core 18 and the crankshaft side core 19 in close proximity to the deepest portion 27, the cut portions 28 and 29 formed by the cylinder side core 18, are positioned distant from the parting plane 25, and corner regions 28*a* and 29*a* of the cut portions 28 and 29 are formed by the large curved surfaces. Therefore, stress generated near the cut portions 28 and 29 can be reduced. By reducing the stress generated near the cut portions 28 and 29 in this manner, the whole thickness of the separating wall 7 can be reduced.

Since the thickness of the separating wall 7 is made smaller on the joint surface 5 side and on the opposite side of the joint surface 5 and the thickness of the whole separating wall 7 can be reduced by reducing the stress at the cut portions 28 and 29, a space defined by the separating walls 7 is increased, and hence an internal volume of each of the crank chambers 6 separated by the separating walls 7 is increased. Thereby, a pressure fluctuation occurring inside the crankcase 1 can be reduced. In addition, a sufficient distance can be provided between the crank web rotating in each of the crank chambers 6 between the crank journal bearing holes 26 and the separating wall 7. This makes it possible to reduce friction resistance of the crank web. As a result, the output of the engine can be increased.

Since the parting plane 25 between the cylinder side core 18 and the crankshaft side core 19 is located in close proximity to the deepest portion 27 of the crank journal bearing hole 26 which is comparatively near the joint surface 5, an operator can easily remove the flash left at the end portion E of the parting plane 25. By positioning the parting plane 25 between the cylinder side core 18 and the crankshaft side core 19 on the crankshaft side C rather than the cylinder side H in the crank chamber 6, the operator can easily remove the flash left at the parting plane 24 from the crankshaft side C (from the joint surface 5 side).

Figure 4A:
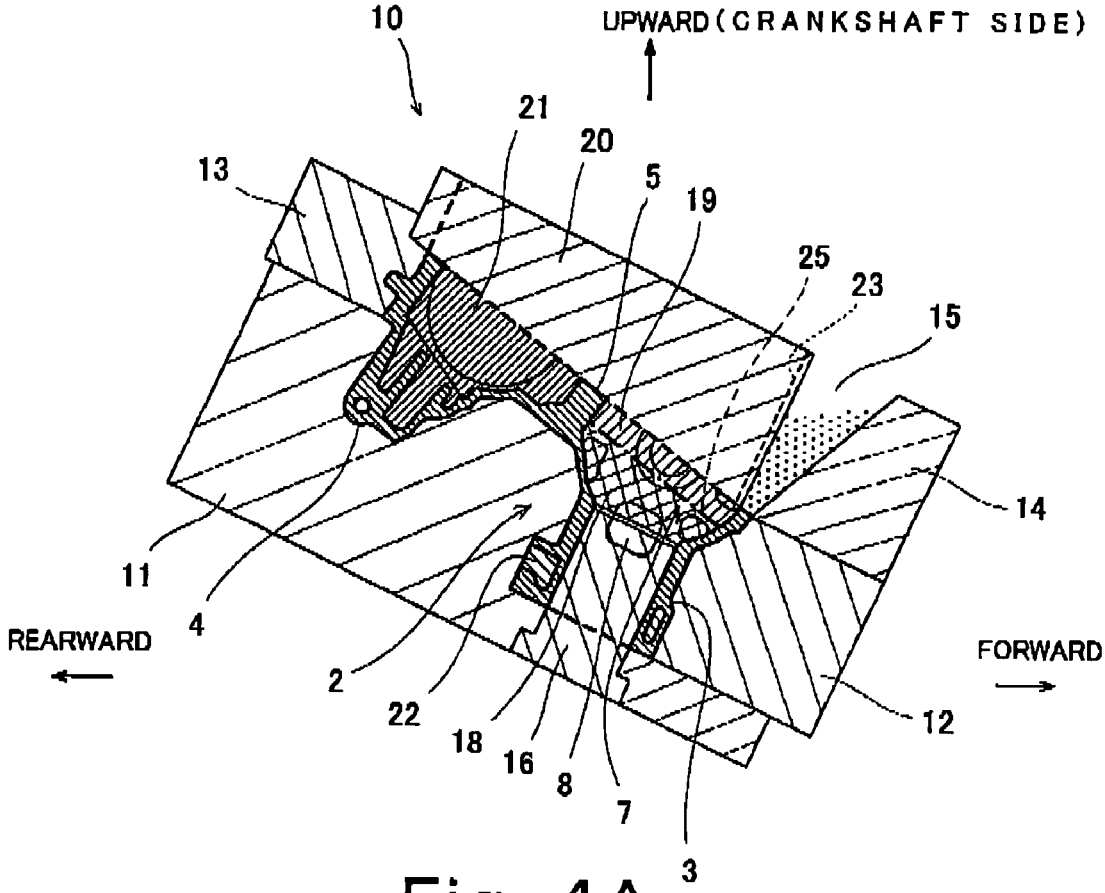
FIG. 4A is a view showing a procedure for casting using a casting mold of FIG. 2, and a state of inclined casting in the procedure.
Figure 4B:
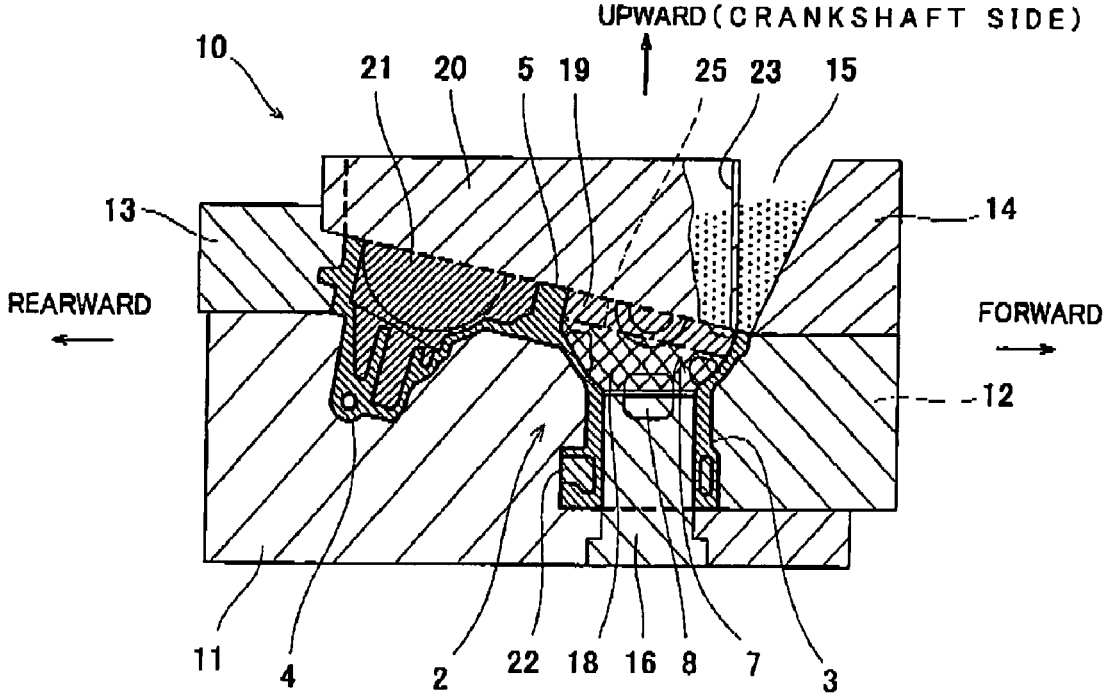
FIG. 4B is a view showing the procedure for casting using the casting mold of FIG. 2, and a state of gravity casting in the procedure.

FIGS. 4A and 4B are views showing a procedure for casting using the casting mold 10 of FIG. 2. FIG. 4A shows a state of inclined casting, and FIG. 4B shows a state of gravity casting. With reference to FIGS. 4A and 4B, the procedure for casting the crankcase 1 using the casting mold 10 will be described. In FIGS. 4A and 4B, liquid metal fed into the casting mold 10 is represented by numerous dots.

As shown in FIG. 4A, at the start of casting, liquid metal is poured by the inclined casting in which the casting mold 10 is inclined by a predetermined angle. At this time, the liquid metal is poured gently over the width of the casting mold 10 from the pouring gate 15 provided at the upper surface (joint surface 5 side) of the front portion of the crank chamber forming part of the casting mold 10. In this manner, the liquid metal is gently flowed into the casting mold 10 by the inclined casting at the start of the casting so that the liquid metal is stably filled into a region between the dies 11, 12, and 16 and the cores 18, 19, and 22. Thus, a pouring advantage of the inclined casting is realized.

Next, as shown in FIG. 4B, the attitude of the casting mold 10 is gradually changed to be oriented horizontally while injecting the liquid metal into the casting mold 10. With the casting mold 10 oriented substantially horizontally, the gravity casting is carried out in such a manner that the liquid metal is filled into the upper transmission forming part from the crank chamber forming part. At this time, since the liquid metal of a specified volume is reserved in the pouring gate 15, the liquid metal is stably filled from the crank chamber forming part into the upper transmission case forming part by the gravitational force of the liquid metal reserved in the pouring gate 15. Thus, the liquid metal is filled quickly by utilizing advantage of falling of the gravity casting. In this manner, after the liquid metal has been filled into the cylinder block forming part, it is quickly filled into the crank chamber forming part and the upper transmission case forming part.

Furthermore, after the liquid metal poured into the casting mold 10 is filled into the crank chamber forming part and the upper transmission case forming part, it is fed from the pouring gate 15 until the liquid metal of a specified volume has been filled into the risers 23 provided in the upper die 20. It should be noted that the risers 23 are located above the separating walls 7 in the crank chamber forming part, and the liquid metal is fed into the risers 23 from below. Thereafter, under the state where the crank chamber forming part and the upper transmission case forming part are subjected to the gravitational force from the liquid metal in the pouring gate 15 and from the liquid metal in the risers 23, the liquid metal equal in amount to solidification shrinkage is fed from the porting gate 15 and the riders 23 into the crank chamber forming part and the upper transmission case forming part, thus forming the upper crankcase 2 including the cylinder block 3 and the upper crankcase 2 as a unitary component.

During casting, the cylinder bore die 16 may be cooled to a specified temperature to inhibit generation of porosities and other imperfections. For example, in a case where aluminum alloy is cast, the cylinder bore die 16 may start to be cooled when its temperature becomes approximately 470° C. to 500° C. Furthermore, the front die 12 may be air-cooled to inhibit temperature of the front die 12 from rising from a specified temperature. For example, in the case where aluminum alloy is cast, the specified temperature is 350° C. to 400° C. Moreover, residual heat may be kept in the crankshaft side core 19 to enable smooth flow of the liquid metal. The residual heat of the crankshaft side core 19 is set to approximately 60° C. to 100° C. in the case where aluminum alloy is cast. These temperature conditions may be suitably set depending on casting conditions.

As described above, in the method of casting the upper crankcase 2, as shown in FIG. 4A, the liquid metal is fed from the porting gate die 14 into the cylinder block forming part via the crank chamber forming part by the gravitational force in the state where the cylinder block forming part of the casting mold 10 is located on the lower side, the crank chamber forming part of the casting mold 10 is located on the upper side, and the casting mold 10 is inclined with a predetermined angle. In this state, then, as shown in FIG. 4B, the attitude of the casting mold 10 is oriented horizontally so that the liquid metal is filled into the crank chamber forming part by the gravitational force. In this manner, the liquid metal is first poured into the cylinder block forming part from the crank chamber forming part by utilizing advantage of the inclined casting, and then is quickly caused to fall into the crank chamber forming part by utilizing the advantage of gravity casting.

As should be appreciated from the above, in accordance with the casting mold 10, by utilizing the advantage of the pouring of the inclined casting and the advantage of the falling of the gravity casting, the liquid metal is filled into the cylinder block forming part and the forming part of the upper transmission case 4. In addition, since the liquid metal is fed from the pouring gate 15 and from the risers 23 in amount to equal to solidification shrinkage, high quality can be achieved for the upper crankcase 2, which includes the cylinder block 3 and the upper transmission case 4.

In accordance with the engine 35 (FIG. 5) including the upper crankcase 2 manufactured as described above, the internal volume of the crank chamber 6 of the crankcase 1 is increased so that a pressure fluctuation in the interior of each of the crank chambers 6 can be reduced and friction resistance of the rotating crank web can be reduced. As a result, the output power of the engine 35 can be increased. In addition, time or labor necessary for finishing an internal structure of the crankcase 1 can be reduced. As a result, the engine 35 can be manufactured at higher yield.

Whereas in the above described embodiment, an upper crank case 2 of an in-line four-cylinder engine is illustrated, the present invention may be applicable to upper crankcases and lower crankcases of other multi-cylinder engines.

Furthermore, whereas efficiency of casting is improved by utilizing the advantage of the pouring of the inclined casting and the advantage of falling of the gravity casting, in some embodiments only the gravity casting may be employed depending upon the number of cylinders and casting conditions.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A crankcase for a multiple-cylinder four-cycle engine, comprising:

an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof;

a separating wall which is integrally cast with the upper crankcase and the lower crankcase to extend from the joint surface toward the opposite side of the joint surface and is configured to define crank chambers corresponding to adjacent cylinders; and a crank journal bearing hole which is formed on the separating wall such that an axis of the bearing hole passes through the joint surface of the upper crankcase and the lower crankcase and is configured to support a crankshaft;

wherein at least the separating wall formed in the upper crankcase has a thickness that increases from the joint surface of the crankcase to a region near a deepest portion of the crank journal bearing hole and decreases from the region near the deepest portion of the crank journal bearing hole toward the opposite side of the joint surface of the crankcase.

2. The crankcase according to claim 1, wherein the upper crankcase has a cylinder block which is formed integrally therewith and is located on the opposite side of the joint surface.

3. The crankcase according to claim 2, further comprising:

a cut portion which is formed in a portion of the separating wall with a thickness that decreases from the region near the deepest portion of the crank journal bearing hole toward the opposite side of the joint surface and is configured to allow the crank chambers corresponding to adjacent cylinders to fluidically communicate with each other, and a corner portion of the cut portion formed on a surface of the separating wall is formed by a curved surface.

4. A multiple-cylinder four-cycle engine comprising a crankcase, the crankcase including:

an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof;

a separating wall which is integrally cast with the upper crankcase and the lower crankcase to extend from the joint surface toward the opposite side of the joint surface and is configured to define crank chambers corresponding to adjacent cylinders; and a crank journal bearing hole which is formed on the separating wall such that an axis of the bearing hole passes through the joint surface of the upper crankcase and the lower crankcase and is configured to support a crankshaft;

wherein at least the separating wall formed in the upper crankcase has a thickness that increases from the joint surface of the crankcase to a region near a deepest portion of the crank journal bearing hole and decreases from the region near the deepest portion of the crank journal bearing hole toward the opposite side of the joint surface of the crankcase.

5. A method of casting a crankcase for a multiple-cylinder four-cycle engine, including an upper crankcase and a lower crankcase which are joined to each other at a joint surface, the upper crankcase having a cylinder block at an opposite side of the joint surface and an upper transmission case at a rear portion thereof, the lower crankcase having a lower transmission case at a rear portion thereof, a separating wall which is integrally cast with the upper crankcase and the lower crankcase to extend from the joint surface toward the opposite side of the joint surface and is configured to define crank chambers corresponding to adjacent cylinders, and a crank journal bearing hole which is formed on the separating wall such that an axis of the bearing hole passes through the joint surface of the upper crankcase and the lower crankcase and is configured to support a crankshaft, the method comprising:

providing a joint surface side core and a joint surface opposite side core, the joint surface side core having a draft for increasing a thickness of the separating wall from the joint surface of the crankcase to a region near a deepest portion of the crank journal bearing hole, the joint surface opposite side core being provided in contact with the joint surface side core and having a draft for decreasing the thickness of the separating wall from the region near the deepest portion of the crank journal bearing hole toward the opposite side of the joint surface of the crankcase;

feeding liquid metal into a casting mold in a state where a parting plane between the joint surface side core and the joint surface opposite side core is located in close proximity to the deepest portion of the crank journal bearing hole; and forming the separating wall to have the thickness that increases from the joint surface of the crankcase to the region near the deepest portion of the crank journal bearing hole and decreases from the region near the deepest portion of the crank journal bearing hole toward the opposite side of the joint surface of the crankcase.

6. The method according to claim 5, further comprising:

forming a cut portion which is formed by the joint surface opposite side core in a portion of the separating wall whose thickness decreases from the region near the deepest portion of the crank journal bearing hole toward the opposite side of the joint surface of the crankcase and is configured to allow the crank chambers corresponding to adjacent cylinders to fluidically communicate with each other;

wherein a corner portion of the cut portion formed on a surface of the separating wall is formed by a curved surface.

* * * * *